United States Patent [19]

Waschk et al.

[11] 4,183,654

[45] Jan. 15, 1980

[54] ELECTROSTATIC COPYING MACHINE UTILIZING FLASH DISCHARGE LAMP FOR ILLUMINATING ORIGINAL AND/OR FIXING TONER IMAGE

[75] Inventors: Fritz Waschk, Unterhaching; Heinz Webersik; Günther Maurischat, both of Munich; Walter Schott, Zorneding, all of Fed. Rep. of Germany

[73] Assignee: AGFA-Gevaert, A.G., Leverkusen, Fed. Rep. of Germany

[21] Appl. No.: 866,657

[22] Filed: Dec. 30, 1977

[51] Int. Cl.[2] ..... G03G 15/00

[52] U.S. Cl. ..... 355/3 FU; 320/1; 355/14 FU; 355/69

[58] Field of Search ..... 355/3 FU, 3 R, 14, 133, 355/69; 320/1

[56] References Cited

U.S. PATENT DOCUMENTS

| | | | |
|---|---|---|---|
| 3,062,095 | 11/1962 | Rutkus et al. | 355/14 X |
| 3,180,239 | 4/1965 | Shearer et al. | 355/3 R X |
| 3,322,098 | 5/1967 | Pegram | 355/3 R X |
| 3,692,401 | 9/1972 | Kawai | 355/3 R |
| 3,698,804 | 10/1972 | Cranskens et al. | 355/11 X |
| 3,831,933 | 8/1974 | Fantozzi | 355/3 R X |
| 3,883,240 | 5/1975 | Ito et al. | 355/3 DD |
| 4,030,823 | 6/1977 | Brugger et al. | 355/8 |

*Primary Examiner*—R. L. Moses

*Attorney, Agent, or Firm*—Michael J. Striker

[57] ABSTRACT

The flash discharge lamp is energized by the discharge of a battery of flash condensors. When an attempt is made to gain access to the flash condensors, these are automatically and quickly discharged through current-limiting resistors, to preclude the danger of electrocution. The fixing station of the copying machine, including the flash discharge lamp, the battery of flash condensors, the transport rollers which transport copying medium through the fixing station and almost all of the electronic control circuitry of the fixing station, are provided on a single housing, removable from the copying machine as a pull-out unit.

22 Claims, 5 Drawing Figures

C
D
B
A
II
II
20
1
2
2a
2b
2c
3
4
5
6
7
8
9
10
11
12
13
14
21
31
31a
31b
31c
31d
31e
32
33
34
35
36
37
38
39
40
41
42
43
44
45
74-80
85
86
90
91
92
93
94
S1
S2
S3

128
3
1
27
29
17
17a
19
125
16
16a
121
2c
7
2
2a
5
1a
22
12
30
8
23
9
20
84
6
2b
23a
15b
15a
18
3a
3b
126
124
120

81
81
2d
4
4a
4b
2
5
2b
5
2b
82
4a
V
2
V
4
4b
81
83
4c
81
2d 88
5b
IV
IV
5b
5a
4
5a
87

ELECTROSTATIC COPYING MACHINE UTILIZING FLASH DISCHARGE LAMP FOR ILLUMINATING ORIGINAL AND/OR FIXING TONER IMAGE

BACKGROUND OF THE INVENTION

The invention relates to electrostatic copying machines of the type provided with a flash discharge tube, used to illuminate an original to be copied, or used to fuse the toner image on the final copying medium, with the flash discharge tube being energized from a condensor battery which is to be accessible for servicing.

With electrostatic copying machines, it is becoming increasingly common to use a flash discharge tube both for the illumination of the original to be copied, and also for fusing the toner image on the final copying medium. In the former case, this makes it possible to expose a stationary original onto a moving copying medium without the use of travelling optical components, because the duration of the exposure is shorter than could give rise to loss of image sharpness on the transported copying medium. If the flash discharge lamp is used to fix a toner image, as described for example in German allowed patent application DT-AS No. 1,063,029, the energy needed to fuse the toner image can be applied in so short a time interval that the heat generated in the toner particles does not have time enough to be transmitted into the copying paper back of the toner image, to any appreciable degree. This type of selective fixing action saves on energy, and furthermore does less damage to the quality of the copying paper used. In both cases, to achieve the desired effect within the time available for the irradiation, a very considerable amount of energy must be utilized and stored in the flash condensors of the machine. These, for reasons of servicing convenience, are frequently arranged on a separate pull-out unit, removable as a whole from the copying machine. However, even after the machine has been disconnected from power, because of the amounts of energy which these condensors must store, a considerable danger of electrocution is presented to the service person who opens up the machine to gain access to its interior.

SUMMARY OF THE INVENTION

It is a very general object of the invention to greatly reduce this danger to service personnel.

According to one concept of the invention, a lid which affords access to the removable flash-discharge-tube and flash-condensor unit, or else a holding structure which holds this removable unit in place in the machine, is provided with a safety switch device which when activated initiates the quick discharging of the flash condensor battery through current-limiting resistors.

Advantageously, a threaded mounting bolt used either to close the access lid or hold the removable flash unit in place, is additionally used to control the safety-switch device. To open the access lid, or to remove the removable flash unit from the machine, the mounting bolt must first be turned a certain number of times. The mounting bolt so cooperates with the actuator of the safety-switch device that the safety-switch device is actuated as soon as the service person even begins to loosen the mounting bolt.

In this way, necessarily, as soon as the service person begins to open the access lid which shields the flash condensor battery from the exterior, there is automatically triggered a quick discharge of the flash condensors through current-limiting resistors. Because this quick discharge is triggered even as the service person begins to loosen the holding bolt, i.e., before he has scarcely begun to turn it through the number of turns needed to actually gain access to the flash unit, it is assured that the flash condensor battery will have discharged, at least down to a voltage level which is no longer dangerous, before the holding bolt has been completely released and therefore before access to the flash condensor battery has even become possible.

Additionally, the present invention contemplates a further safeguard against the possibility of electrocution when servicing the copying machine. This further safeguard involves the provision of a circuit breaker unit. The circuit breaker disconnects the copying machine from power when a shut-off switch is activated and/or in automatic response to copying-machine malfunctions of various types. The circuit breaker includes a self-holding circuit which, when the circuit breaker is switched on and connects the copying machine to power, is controlled by a normally open contact. The circuit breaker includes an additional normally closed contact which closes when the circuit breaker drops out to thereby short circuit the flash condensor battery through the intermediary of current-limiting resistors. Any properly trained service person knows enough to disconnect the wall plug of the copying machine before undertaking any work in the interior of the machine. By forcing the service person to disconnect the machine from power by activating the circuit breaker, and because the circuit breaker then causes the flash condensors to discharge, the possibility that the service person will forget about discharging of the flash condensors, e.g., because he is initially investigating a part of the machine remote from the flash condensors, will be very greatly reduced. These features also become of importance in certain other recurring situations. For example, if service is performed during a power failure or after a machine malfunction which occurs while testing out the machine, the service person may be "lured" into doing service work without first disconnecting the machine from power. As another example, a service person may be doing service work in a completely safe zone of the copying machine and, by the time he begins to work nearer the flash condensor unit, may have incorrectly assumed that the flash condensors are no longer highly charged.

The invention furthermore contemplates a particularly simple way of implementing the double safeguard action in question. In particular, the safety switch which triggers quick discharge of the flash condensors when an attempt is made to gain access to the flash unit, can be connected in the self-holding circuit of the circuit breaker.

The invention is additionally concerned with the possibility that the discharged condensor battery may accidentally become recharged after the acess lid has been opened, for example as the service person is in the process of removing the flash unit. To prevent this from happening, the removable unit containing the flash condensor battery is provided with additional safety switches. As the flash unit begins to be removed from the machine, these cause the condensor battery to be short-circuited through the intermediary of current-limiting resistors provided on the removable flash unit itself.

In each of these cases, it is preferred that the current-limiting resistors employed have resistances such that the discharge of the flash condensor battery occurs with a time constant between 0.1 and 1.0 seconds. If, in addition thereto, the flash condensor battery is permanently connected to discharge resistors which constantly discharge the condensor battery, then it is preferred that the discharge time constant established by those discharge resistors amount to a few minutes. The discharge time constant between 0.1 and 1.0 seconds assures, in general, a sufficiently quick discharge, without the development of excessively high discharge current. The permanently connected discharge resistors, on the other hand, due to their relatively long discharge time constant cannot interfere with normal functioning of the machine, and yet serve to safely discharge the condensor battery when longer times elapse between interruption of machine operation and the commencement of service work.

To spare the safety switches during normal operation, and also in order to be able to discharge the flash condensors for safety purposes through the flash discharge lamp itself, the invention furthermore contemplates the provision of a control unit which fires the flash discharge lamp whenever the copying machine is shut off, for example after a copy has been made.

Because of the amount of radiant energy needed for the purposes in question, a single flash condensor is frequently not sufficient for the energization of the flash discharge tube. According to a further concept of the invention, the battery of condensors is subdivided into at least two component sections. A circuit compares the voltages to which each component section has been charged, or compares their charging currents. If a discrepancy as between the charging states of the component sections is detected, then the charging of the relevant component section is slowed or interrupted, in order to prevent overloading of the charging circuitry as a result of unsymmetrical charging. Also, the fact that such a discrepancy is arising is indicated, in order to give warning that part of the condensor battery may be defective, i.e., before any damage can result.

Advantageously, the current path of the battery of condensors, or the current paths of the individual condensors, is provided with an adapter circuit parallel thereto, into which a measuring unit can be readily and safely plugged to measure the voltage to which the condensors have been charged. The adapter circuit includes current-limiting resistors and cooperating zener diodes and/or glow discharge lamps which limit the voltage which can become applied across the terminals of the voltage-measuring unit. In this way the maximum voltage which can become applied across the terminals of the voltage-measuring unit can be kept down to a very low value, mainly determined by the relationship between the breakdown voltage of the glow lamp or zener diode and the resistance of the current-limiting resistors. If no measuring unit is connected to the adapter circuit, each such glow lamp serves as an indicator for the state of charging of the condensors.

In the preferred embodiment of the invention, the condensor battery, together with a flash discharge tube and also transport and guide means for copying medium whose toner image is to be fixed, are all arranged to form parts of a single pull-out unit, removable from and reinsertable into the copying machine, i.e., as a whole. Advantageously, a cooling-air passage is provided which communicates with the condensor-battery compartment of this pull-out unit, when the pull-out unit is in operative position in the copying machine.

In this way, when operating the condensor-battery-energized flash lamp to fix toner images, it becomes possible to avoid long flash-energy transmission lines containing connector junctions. With the high level of flash energy in question, if the condensor-battery discharge circuit included even a simple plug and socket connection having per se a resistance of only a few tenths of an ohm, this could result in wasteful energy dissipation on the order of magnitude of 10–20% of the energy otherwise available for the flash discharge. This is here avoided, when the condensor battery and flash discharge tube are part of a single removable unit and are permanently connected to each other, i.e., without the intermediary of plug-and-socket or other such connectors. Furthermore, when the removable flash unit is inserted into operative position, its interior compartments automatically become part of the cooling-air system of the copying machine. Accordingly, despite the high level of flash energy in question, sufficient cooling of the flash condensors is assured. It is to be noted that the operating temperatures of the flash condensors, particularly if they are electrolytic condensors, should not be permitted to rise above about 80° C. within any location whatsoever in the interiors of the condensors, it being a necessity that the temperature of the externally accessible surfaces of the machine be kept as much as possible below about 40° C. In order to achieve this, a stream of cooling air, as cool as possible, and of relatively high volumetric flow rate, must be guided through the flash-condensor compartment of the unit.

The reasons why the flash discharge lamp is provided on the same pull-out unit as the flash condensors have been explained above. The flash discharge lamp itself generates a considerable amount of heat. Furthermore, one must take into account that the operating temperature of the flash tube will be considerably higher than that of the flash condensors. In contrast to the cooling air emerging from the flash-condensor compartment, that emerging from the flash-tube compartment may contain gases and vapors generated during the intensive irradiation of the toner powder to be fixed. This necessitates that the latter cooling air be passed through a filter before being discharged into the ambient air, which necessarily tends to lower the volumetric flow rate of this cooling air.

In view of these problems, the invention contemplates separate cooling-air passages for the flash-condensor compartment and the reflector compartment of the removable unit, with a carbon filter being provided at the downstream end of the cooling-air passage for the reflector compartment.

According to another concept of the invention, the machine is provided with a lid which covers and renders inaccessible the pull-out flash unit when the latter is in inserted position. The lid is configured to include curved portions which form part of the guidance system for the copying medium, deflecting the copying-medium sheets discharged from the fixing station downwards as such sheets emerge. Furthermore, the lid is provided with an activating element for the safety switch provided on the removable flash unit.

In the preferred embodiment of the invention, most of the circuit components connected to the flash tube and flash-condensor battery are provided on the removable flash unit itself, and are pulled out from the machine together with the flash unit. The circuit components are provided on a pivotal plate on the flash unit, and are connected together in operative configuration, to facilitate servicing and testing. What few electrical connections must be made, i.e., between the circuitry on the removable flash unit and circuitry not on the removable flash unit, are made automatically upon flash-unit insertion. This is accomplished by correctly positioning, for example, plug-and-socket type connectors on the removable flash unit and the support for it within the copying machine.

Preferably, the individual condensors of the condensor battery are arranged parallel to each other, like a grill which extends across the cooling-air stream for the condensors, with the condensors being held in position at their ends by holding brackets. In this way, their cooling air cools them equally, and the cooling air has access to all portions of these condensors. Preferably, the condensor battery is made up of electrolytic condensors. The ends of the condensors provided with relief valves for internal electrolyte are all held by the same holding bracket, and the latter is configured to accommodate a protective diaphragm, to prevent discharged electrolyte from reaching components which could become damaged. The connector lines for the condensors extend within this holding bracket, parallel to it. Preferably, the condensor battery is made up of cylindrical metal-cased condensors whose external dimensions have a diameter:length ratio of 1:3.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
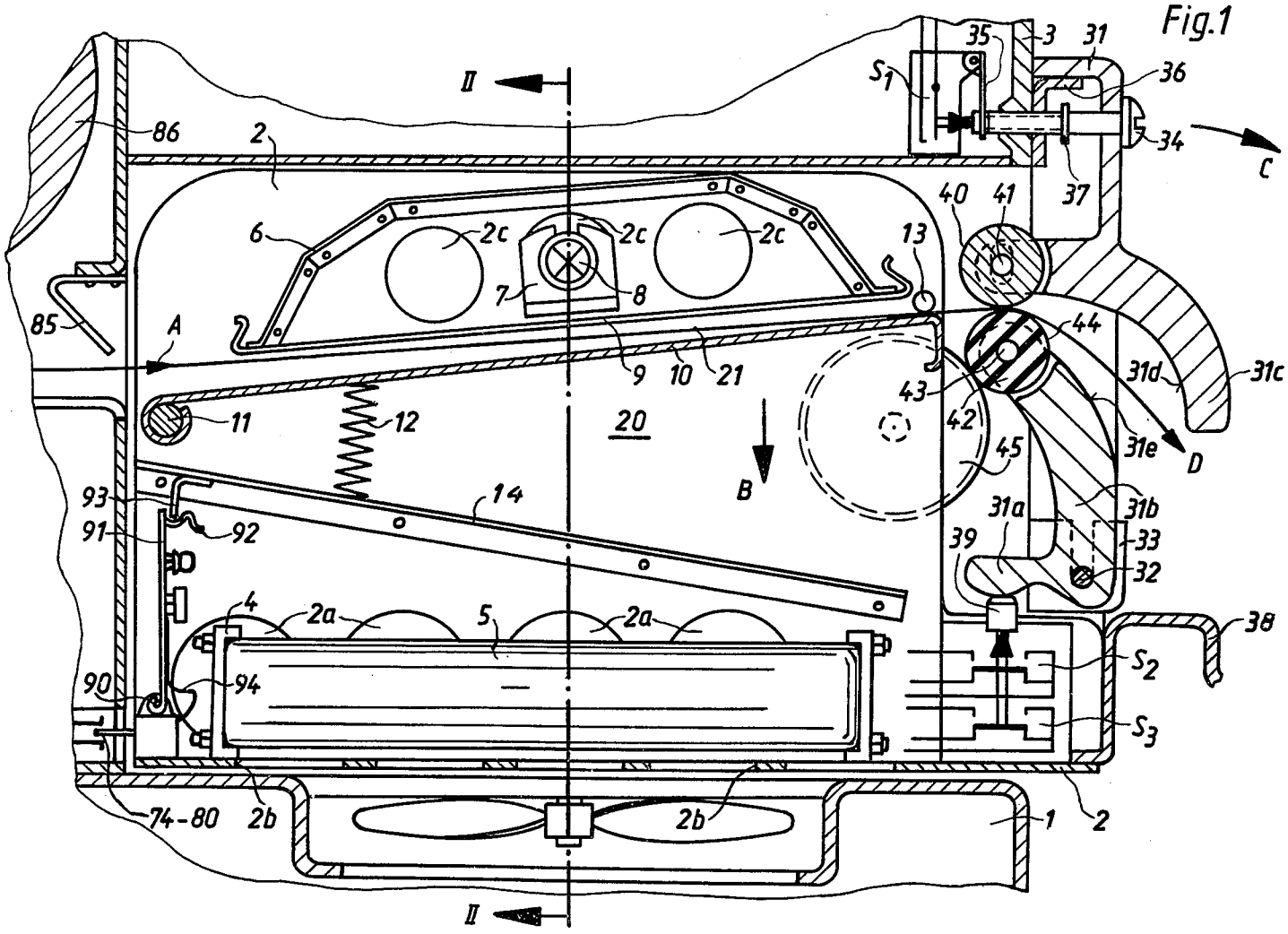
FIG. 1 is a section taken through an exemplary embodiment of the invention, along section line I—I of FIG. 2.
Figure 2:
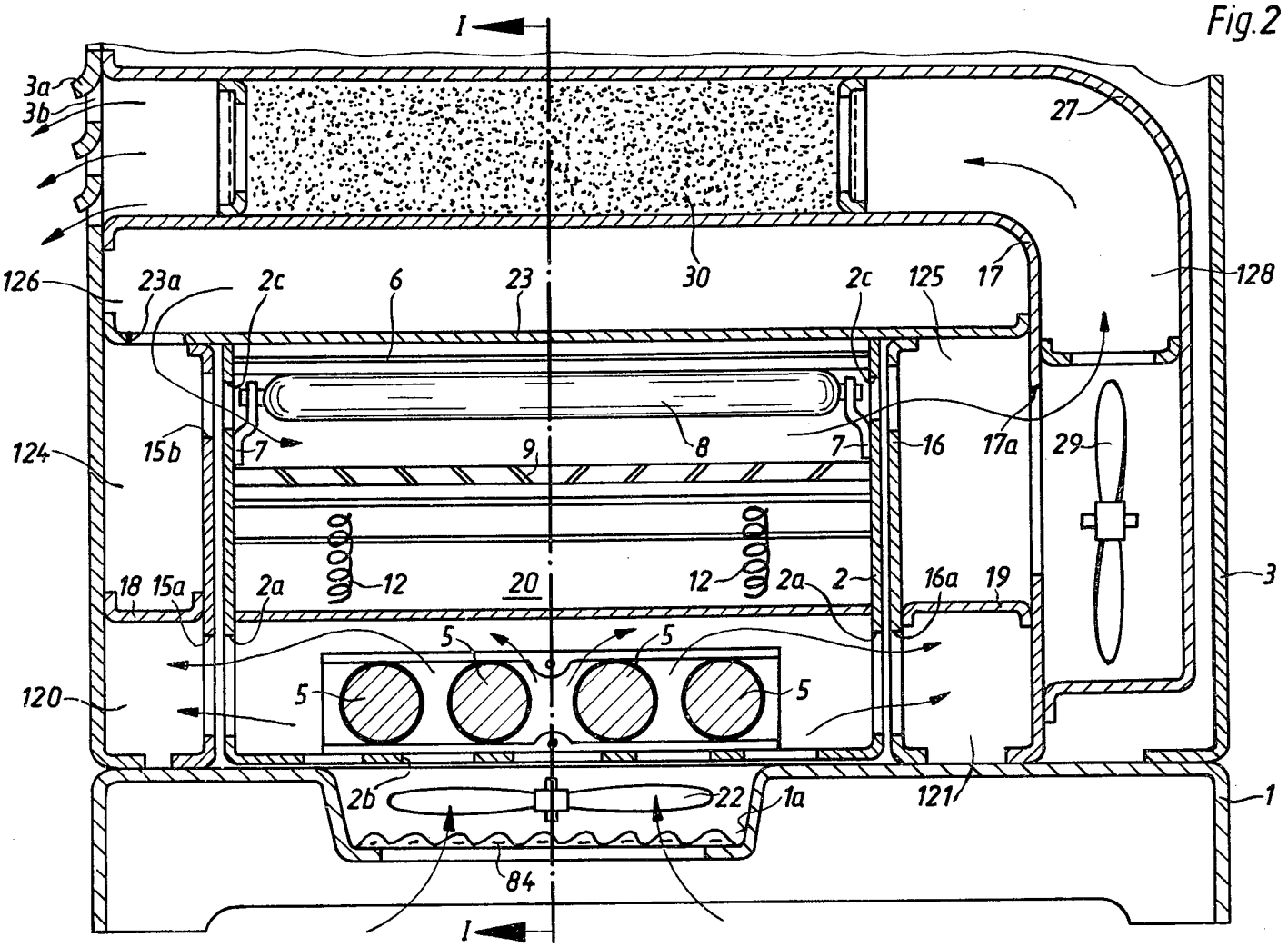
FIG. 2 is a section through the structure shown in FIG. 1, taken along section line II—II.

As shown in FIGS. 1 and 2, a housing base 1 supports the U-shaped housing 2 of a radiant-energy fixing unit 20. Fixing unit 20 is removable, as a whole, i.e., as a single unit, from the housing 3 of the copying machine. Inside housing 2, holding brackets 4 mount four condensors 5, constituting a condensor battery. Secured between the side walls of the U-shaped housing 2 is a reflector 6. Holding brackets 7 hold a flash discharge tube 8 in place within the reflector 6.

Guide wires 9 (best seen in FIG. 1) stretch across the lower, open face of the reflector 6. The wires 9 prevent the flash discharge tube 8 from being physically contacted by the recording medium 21 which is being transported through the fixing station in the direction of arrow A. Arranged below the guide wires 9 is a pivotable guide plate 10 for the recording medium 21 to be fixed. Guide plate 10 is pivotally mounted on a rod 11 and, in its operative position, is urged by springs 12 against stops 13. The guide plate 10 can if necessary be swung down in the direction of arrow B, to facilitate removal of a jammed sheet of copying medium 21. When guide plate 10 is thusly swung down, it occupies a position parallel to a separating wall 14, which separates the condensor compartment of the pull-out unit 20 from the reflector compartment thereof.

The interior of the condensor compartment of the pull-out unit 20 communicates, via lateral openings **2*a* in its housing 2, with cooling-air channels 120,121 formed by walls 15–19. For this purpose, the walls 15 and 16 have openings 15*a* and 16*a* which register with the openings 2*a* in the housing 2 of the pull-out unit 20, when the latter has been pushed into its operating position. The condensor compartment additionally communicates, via openings 2*b*, with an air chute 1*a* in the housing base 1. The air chute 1*a* contains a fan 22. The fan sucks cooling air in from outside the machine, serving to cool the condensors 5, and conducts the air through the channels 120,121 into other compartments of the machine such as require cooling, for example the electronics compartment of the machine. The cooling air for the condensors thus is sucked in directly from outside the machine, and does not first travel through, and be warmed up in other compartments of the machine; the high-power condensor battery requires especially effective cooling. A screen or grid 84 protects the fan 22 and the condensor battery 5** from physical contact by foreign bodies which may come in with the cooling air.

Further cooling-air channels 124,125 formed by the walls 15–19 and by an intermediate wall 23 communicate, via openings **15*b*,16*b* in the walls 15,16 and via openings 2*c* in the housing of the unit 20, with the reflector compartment of the removable unit 20. The channel 124, in turn, communicates via openings 23*a* with a cooling-air channel 126. The channel 126, upstream of its communication with channel 124**, receives air which has been warmed up in some other interior compartment of the machine requiring cooling, e.g., the electronics compartment of the machine.

Openings **17*a* in the wall 17 lead from channel 125 to a cooling-air channel 128 formed by wall 17 and a further wall 127. Channel 128 contains a fan 29 and a carbon filter 30. Fan 29 accordingly draws air which has been somewhat prewarmed from the interior of the machine through the reflector compartment and across the surface of the recording medium to be fixed, and then discharges such air into the ambient atmosphere through the intermediary of the carbon filter 30 and out through outlet slots 3*b* defined by inclined guide surfaces. Due to the provision of the carbon filter 30**, the cooling air flowing through the reflector compartment has removed from it any ozone which may form in the region of the flash lamp due to the intense flash radiation, and any synthetic resin vapors which may form when constituents of the developer decompose into individual synthetic-resin components.

Due to the subdivision of the removable unit 20 into two separately cooled zones, it becomes possible, on the one hand, to optimally cool the condensor compartment and, on the other hand, to optimally keep the reflector compartment free of gases injurious to health; the requisite connections for the cooling-air system, due to the aforedescribed spatial coordination of the cooling-air openings in the walls of the housing of unit 20 and the various cooling-air channels, are automatically established when the pull-out unit 20 is pushed into position in the machine. In this way, both the condensors and also the flash lamp can be arranged on one and the same removable unit, for purposes of quick and convenient servicing.

To secure the removable unit 20 in its operating position, the opening in the housing of the machine through which the removable unit 20 is inserted into its operating position is provided with a cover 31. The housing of the machine is provided with two upwardly open holding hooks 33. The cover 31 is at its bottom provided with mounting pins 32 received in the holding hooks 33. In this way, the cover 31 is at its bottom hung onto the housing of the machine. At its upper end, the cover 31 is screwed onto the housing 3 of the machine by means of a threaded bolt 34. When threaded bolt 34 is tightened, it projects somewhat into the interior of the machine housing and deactivates the activating lever 35 of a safety switch $S_1$, whose function will later be described with reference to the circuit diagram shown in FIG. 3. The upper part of cover 31 is provided with a downwardly bent tab 36, and the bolt 34 with a safety ring 37. If the cover 31 is opened or removed from the machine, the safety ring 37 is thereby confined, and the bolt cannot fall off the cover 31.

When threaded bolt 34 is unscrewed, cover 31 can be swung down in the direction of arrow C, and thereafter removed by lifting its mounting pins 32 out of the upwardly open holding hooks 33. This provides access to the removable unit 20. The service person inserts his fingers under the ledge-like handle 38 and can pull the unit 20 out of the machine. Previous to this, however, i.e., at the time that the cover 31 was swung down in the direction of arrow C, a projection 31*a* on the cover 31 has already opened an activating element 39 to change the settings of safety switches $S_2$ or $S_3$ provided on the removable unit 20. The function of these two switches is described below with respect to FIG. 3.

Finally, the cover 31 is provided with ledge-like projections 31*b*,31*c*, whose facing surfaces 31*d*,31*e* form a downwardly curved guide passage for the copying medium 21 emerging from the fixing station. This configuration of the guide passage assures that, when the removable unit 20 is in operating position and the cover 31 is closed, the light from flash lamp 8 will not be able to pass out of the machine and hurt the eyes of an operator standing nearby, during the performance of the high-energy flash discharge. Additionally, the infeed side of the removable unit, through which copying medium enters from the photoconductive drum 86, is provided with a downwardly curved light-blocking plate 85, shaped to intercept stray radiation which could otherwise reach the photoconductive drum, and simultaneously serves as a guide member for the incoming copying medium 21.

The projections 31*b*,31*c* are provided with cut-outs in which are mounted a pair of transport rollers 40,42. The mounting shaft 41 of transport roller 40, at its axial ends, is received within longitudinal mounting slots at the two ends of part 31*c*; transport roller 40 bears down, with its own weight, upon transported copying medium. The mounting shaft 43 of transport roller 42, at its axial ends, is received in bores at the two ends of part 31*b*. Secured to the shaft 43 of driven transport roller 42 is a gear 44, meshing with a drive gear 45 rotatably mounted on the housing. The engagement between the two gears is automatically brought into being when the cover 31 is closed. The two transport rollers 40, 42 also serve as additional means for preventing stray radiation from reaching the outside of the machine. Furthermore, to electrostatically discharge the outfed copying medium, the transport rollers 40,42 are provided with a coating of at least somewhat electrically conductive material, e.g., electrically conductive elastomer, and are conductively connected to each other.

The removable unit 20 is provided with a holding plate 91 upon which are provided those electronic circuit components which are to remain on the unit 20 when the latter is pulled out from the machine. The holding plate is pivotally mounted at 90. Plate 91 is normally kept in its illustrated operative position, by means of a snap-action spring 92 which cooperates with a ledge 93. If plate 91 is to be swung down, the electronic circuit components mounted on it continue to be electrically connected to the other electrical components of the removable unit 20, by means of flexible leads 94.

Figure 3:
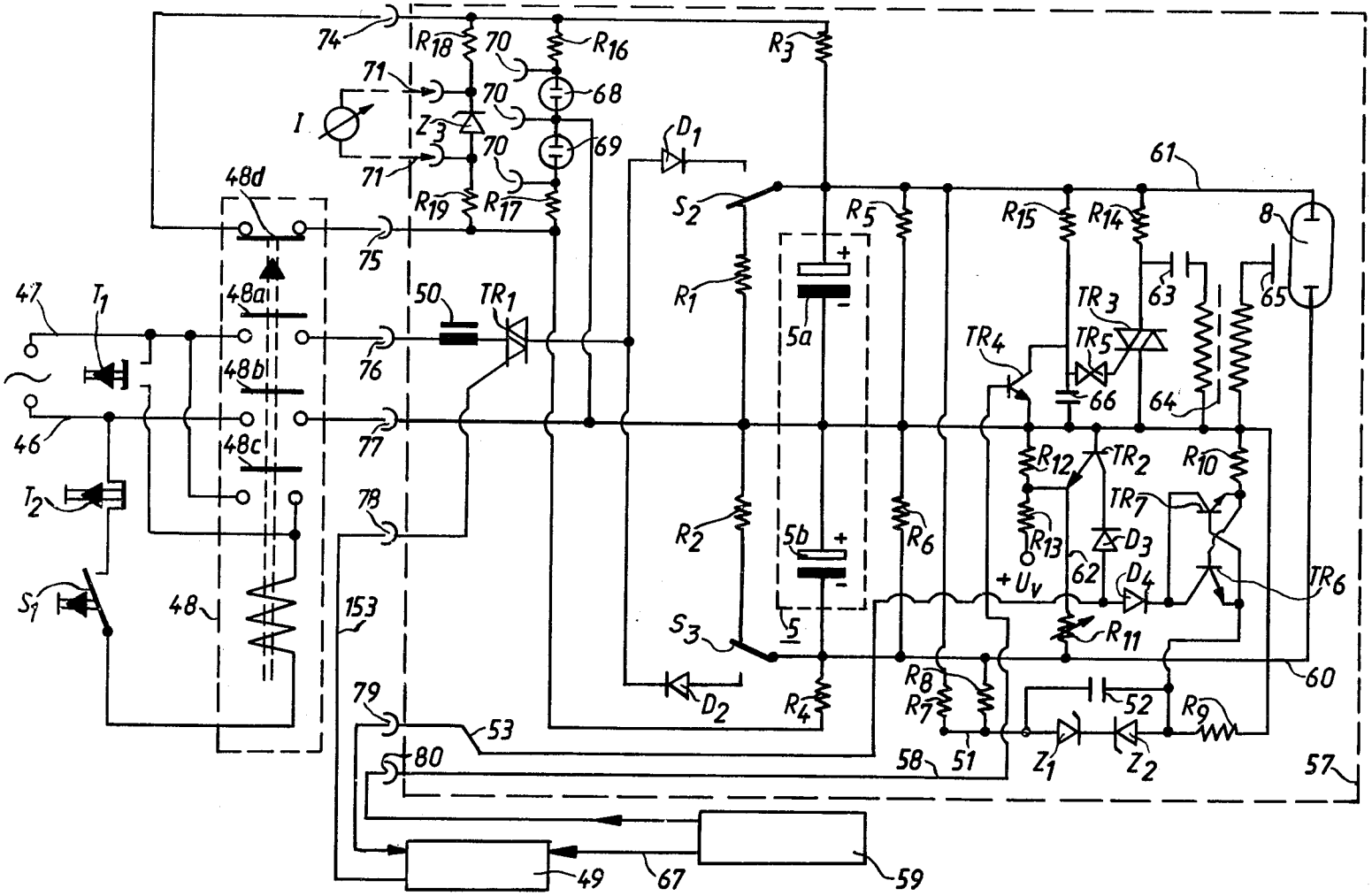
FIG. 3 depicts the circuitry of the arrangement.

The circuit depicted in FIG. 3 is provided with power-supply lines 46,47 which can be connected into the wiring system of a building. The circuit is provided with a circuit breaker 48 which comprises two normally open contacts 48*a*, 48*b*, a self-holding contact 48*c* and a normally closed contact 48*d*. In the self-holding circuit of circuit breaker 48, there is provided a pushbutton switch $T_1$ for turning the machine on, and a pushbutton switch $T_2$ for interrupting operation of the machine. Additionally, the circuit breaker 48 can be caused to drop out by means of the safety switch $S_1$ (also shown in FIG. 1). Switch $S_1$ is normally held closed during operation of the machine, by the threaded bolt 34 which holds the cover 31 closed (FIG. 1).

When the circuit-breaker contacts 48*a*,48*b* are closed, the condensors 5 can be charged up via the diodes $D_1$, $D_2$ each of which blocks one phase of the A.C. supply current, provided that the changeover switches $S_2$ and $S_3$ are in their non-illustrated settings, connecting the condensors 5 to these diodes. As illustrated in FIG. 1, these switches $S_2$ and $S_3$ are moved, by means of the projection 31*a* on the cover 31, into the settings making possible charging up of the condensors 5, if the cover 31 is closed.

When the switches $S_2$ and $S_3$ are in the settings shown in FIG. 3, i.e., with the cover 31 of FIG. 1 open, the condensors 5 are short-circuited by means of current-limiting resistors $R_1$ and $R_2$. The resistance values of $R_1$ and $R_2$ are such that the time constant for the discharging of the condensors 5 is between 0.1 and 1.0 seconds. A further discharge-current circuit, having a time constant between 0.1 and 1.0 seconds, is formed upon closing of the normally closed contact 48*d* of the circuit breaker 48 and includes current-limiting resistors $R_3$ and $R_4$. There are also provided in the current path of the flash condensors discharge resistors $R_5$ and $R_6$ permanently connected thereto, i.e., not by means of switches or disconnectable connectors, and serving to constantly discharge the condensors 5*a*,5*b* with a discharge time constant on the order of, e.g., five minutes.

To control the charging of the condensor battery 5, the power supply line 47 includes a triac $TR_1$ which is controlled, via a control line 153, by a charge-up control unit 49. The charge-up control unit 49 can, for example, be of the type disclosed in commonly owned copending U.S. patent application Ser. No. 819,825 of Guenther Maurischat, filed July 28, 1977, the disclosure of which is incorporated herein by reference. With that charge-up control circuit, the triac is rendered conductive with a special form of firing-angle control in dependence upon the instantaneous value of the voltage to which the condensor has been charged, resulting in the charging of the condensors with charging current pulses of approximately equal amplitude. To further equalize the charging current, a reactive impedance is provided, here in the form of a low-resistance iron-core choke 50.

The charge-up control technique disclosed in the above-identified application is modified in the present case, to the extent that use is made of two resistors $R_7$ and $R_8$ forming a voltage divider connected between the positive terminal of condensor 5*a* and the negative terminal of condensor 5*b*. So long as the voltages across the two condensors 5*a*,5*b* are the same, the line 51 connected to the junction of the equal-value resistors $R_7$ and $R_8$ will be at a value corresponding to that of the neutral conductor 46.

The conductor 51 is connected to a control line 58 via two opposite-polarity zener diodes $Z_1$, $Z_2$, a capacitor 52, and two cross-connected transistors $TR_6$, $TR_7$ together forming a control unit whose purpose will be explained further below. This control unit modifies the operation of the charge-up control unit 49 in such a manner that the latter interrupts or at least slows down the charging of the condensors 5, if control line 53 is carrying current.

So long as one of the zener diodes $Z_1$ and $Z_2$ is non-conductive, i.e., because the voltage difference between lines 51 and 46 is lower than the zener voltage of whichever one of the zener diodes happens to be reverse-biased at this moment, the voltage variations resulting from the intermittent charging-up of the condensors 5 are differentiated by the capacitor 52. Accordingly, the current flowing through resistor $R_9$ corresponds to the time derivative of the variations in the voltage across condensors 5. When the instantaneous voltage at resistor $R_9$ exceeds the threshold value for transistors $TR_6$ and $TR_7$, one or the other of these becomes conductive, depending upon the polarity of the voltage across $R_9$, and permits current to flow in control line 53. This current in line 53 controls the operation of the charge-up control unit 49 in such a manner that the two condensors 5*a* and 5*b* charge up equally. When the voltage difference between lines 51 and 46 becomes so great that one of zener diodes $Z_1$ and $Z_2$ breaks down, one of the transistors $TR_6$ and $TR_7$ undergoes a change of conduction state such that the charging is interrupted. Resistor $R_{10}$ is necessary for reasons of circuit symmetry.

Between the neutral line 46 and one of the supply lines 60, 61 of the condensor battery 5, there is provided an adjustable resistor $R_{11}$ which is connected via a line 62 to the tap of a voltage divider $R_{12}$, $R_{13}$ connected at one end to the neutral line 46. The other end of this voltage divider is connected to a reference voltage $+U_v$, e.g., +4 V. Connected to line 62, and thus to the junction between the voltage divider tap and adjustable resistor $R_{11}$, is the emitter of an npn transistor $TR_2$, whose base is connected to neutral line 46 and whose collector is connected to control line 53. The setting of adjustable resistor $R_{11}$ determines how high the negative voltage on the supply line 50 of condensor battery 5 must be to forward-bias the base-emitter junction of transistor $TR_2$ and initiate current flow from the emitter of the latter through the control line 53, to cause the charging operation to be interrupted. With this circuit arrangement, accordingly, one positively sets the voltage level to which only one of the condensors 5*a*, 5*b* is to be charged; the voltage level to which the other of the condensors is charged is caused to have the same value, by means of the already described control circuit which monitors the symmetry of the charging operation and influences the operation of the charge-up control unit 49. The two diodes $D_3$ and $D_4$ prevent interference between the two circuits working off the common control line.

The firing of the flash discharge tube 8 is effected by a triac $TR_3$ which triggers the discharge of a capacitor 63. The discharge current of the latter flows through the primary winding of a firing transformer 64, across whose secondary winding is induced the firing voltage for the firing electrode 65 of the tube 8. The charging of capacitor 63 up to a suitable voltage level, preliminary to such firing, occurs via a resistor $R_{14}$.

The triac $TR_3$ is, in turn, controlled by a transistor $TR_4$, which latter becomes non-conductive when its base voltage is removed. Base voltage is applied to transistor $TR_4$ via a control line 58 from a copying-machine control unit 59. Control unit 59 may be of the type disclosed, for example, in German Pat. No. 20 46 681. Control unit 59 is operative for terminating current flow in control line 58 at the end of each one-copy or multiple-copy copying cycle of the copying machine, or in response to a copying-machine malfunction, and thereby initiates discharge of flash tube 8 at the end of the copying cycle or in the case of machine malfunction.

When transistor $TR_4$ is thusly rendered non-conductive, capacitor 66 charges up via resistor $R_{15}$. When the voltage on capacitor 66 reaches the breakdown voltage of diac $TR_5$, the diac becomes conductive, and capacitor 66 discharges through the resistance of the control current path of the triac $TR_3$, rendering the latter conductive. The values of resistor $R_{15}$ and capacitor 66 are so selected that the time elapsing from the moment transistor $TR_4$ goes conductive is longer than one half-cycle of the A.C. supply voltage. This assures that triac $TR_1$ is in the non-conductive state before the flash lamp is fired. This prevents the flash-lamp discharge from having any backflow effect upon the A.C. power supply, e.g., the wiring system of a building.

The copying-machine control unit 49, as already mentioned, is activated at the end of each copying operation which the machine performs in response to pressing of the start button of the machine. Additionally, however, unit 49 can be activated each time a sheet of copying medium becomes jammed in the fixing station, and/or when the supply bin for sheets has been exhausted, and/or when the supply of toner has become exhausted, and/or when the drum-cleaning sliver has been used up, etc.

Such copying-machine control units always contain a line, e.g., the supply line of the machine drive motor or of a magnetic coupling, which ceases to carry current when the machine comes to a stop. To such a line are connected the control line 58 and a further control line 67 leading to the charge-up control unit 49, and serving to prevent charging of the condensor battery 5 when the copying machine is stopped. The copying-machine control unit 49 may additionally contain a synchronizing switch operative, in response to the initiation of a radiant-energy fixing operation, for effecting repeated (multiple) firings of the flash tube at a certain repetition frequency, in order to be able to irradiate a continually transported copying-medium sheet of large surface area.

The current path of the condensors 5a, 5b furthermore includes an adapter stage, to which a measuring instrument can be connected for measuring the voltage across the condensors. The adapter stage includes a voltage divider $R_{16}$, $R_{17}$ and intermediate glow discharge lamps 68, 69, and a voltage divider $R_{18}$, $R_{19}$ and an intermediate zener diode $Z_3$. The terminals of the glow discharge lamps 68, 69 and of zener diode $Z_3$ are provided with respective plug connectors 70, 71, into which the prongs of a measuring unit I can be plugged. The glow lamps 68, 69, the zener diode $Z_3$ and the current-limiting resistors $R_{16}$ to $R_{19}$ assure that the maximum voltage applied across the terminals of measuring unit I cannot exceed the breakdown voltage of the glow lamps or of the zener diode. If the measuring unit I is not connected, the current flowing through these voltage dividers will be small. In that case, the presence of voltage across the condensors can be visually ascertained from the glow lamps 68, 69 themselves. If the measuring unit I is connected to the sockets 70 or 71, the relatively small impedance presented by the measuring unit causes the voltage across the glow lamps 68, 69 or across the zener diode $Z_3$ to collapse. A current whose magnitude is proportional to the condensor voltage flows only through the measuring unit and the latter, if properly calibrated, indicates the voltage present on the condensors.

The broken line 57 in FIG. 3 encloses those circuit components which are mounted on the pull-out flash unit 20. The electrical connections between these circuit components and the remaining circuit components in FIG. 3 is effected by means of plug and socket connectors 74–80. The plug and socket connectors are so spatially arranged on the housing of the removable unit and on the housing of the copying machine, that when the former is correctly inserted in the latter, all electrical connections become established automatically.

Figure 4:
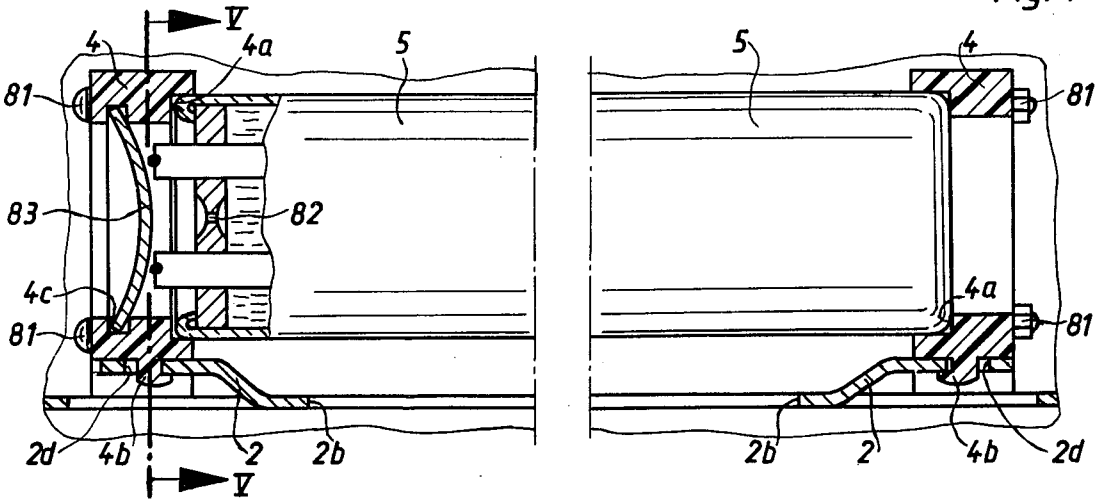
FIG. 4 depicts how the condensors of the flash condensor battery are mounted.
Figure 5:
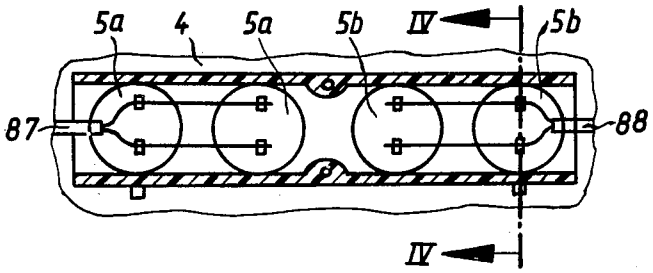
FIG. 5 depicts how the condensors are electrically connected.

FIGS. 4 and 5 depict details of the mounting of the individual condensors 5a, 5b of the condensor battery 5. Use is preferably made of aluminum-electrolyte condensors. The casings of the condensors are clamped at their ends in the recesses 4a of the holding brakets 4. The holding brackets 4 are held together by tightened threaded bolts 81 and nuts. The bottom sides of the holding brackets 4 have hook-like formations 4b, which engage in bores 2d in the housing 2 of the removable flash-lamp fixing unit 20. The diameter of the bores 2d is so selected that the hook-like formations 4b can just push through them, so long as the spacing between the hooks 4b corresponds to the spacing of the bores 2d. When the threaded bolts 81 are then tightened, the hooks 4b grip under the housing wall 2 and thereby connect the brackets 4 onto the unit 20.

The holding bracket 4 at the heads (left ends) of the condensors 5 is formed with a groove 4c, into which is inserted a diaphragm 83 of elastic synthetic plastic material, or the like, after the condensors are mounted and connected. This diaphragm prevents any electrolyte emitted from the safety valves 82 of the condensors from spreading out into the interior of the unit 20, and especially from reaching the vicinity of the electronic components on the circuit plate 91 (FIG. 1). To make possible the insertion of the diaphragm 83, the lines 87 and 88 to the condensors 5a, 5b are led out at the sides of the condensor battery, as shown in FIG. 5.

The holding arrangement shown in FIGS. 4 and 5 for the condensors 5a, 5b assures that the casings of the condensors, which for thermal reasons should anyway be of long and slim configuration, can present themselves to a stream of cooling air like a grill and be accessible to cooling air on all sides. Due to the elongate shape of the condensors, the heat generated in their interiors can furthermore readily pass to their exteriors.

It will be understood that each of the elements described above, or two or more together, may also find a useful application in other types of circuits and constructions, differing from the types described above.

While the invention has been illustrated and described as embodied in a particular type of electrostatic copying machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copying machine, in combination, a flash discharge tube; means for causing the discharge tube to produce a flash, including a battery of flash condensors; and safety switch means operative, in response to an attempt to gain physical access to the flash condensors, for automatically effecting the quick discharging of the battery of flash condensors, furthermore including circuit-breaker means operative when tripped for disconnecting the electrostatic copying machine from external power, and means operative in response to tripping of the circuit-breaker means for effecting quick discharging of the battery of flash condensors.

2. In a copying machine as defined in claim 1, the machine including turnable locking means operative when closed for preventing access to the condensor battery and when opened by service personnel permitting access to the condensor battery, opening of the turnable locking means requiring that the locking means be turned by the service personnel a plurality of times, the safety switch means comprising means operative for quickly discharging the battery of flash condensors in response to the start of turning of the turnable locking means.

3. In a copying machine as defined in claim 1, the circuit-breaker means comprising a relay winding, normally open relay contacts which when maintained closed by the energized winding keep the copying machine connected to external power, and a self-holding circuit including a normally open self-holding relay contact operative when closed for maintaining the winding energized, the means responsive to tripping comprising a discharge circuit connected to the condensor battery for discharging the latter including at least one current-limiting resistor and a further normally open relay contact which closes the discharge circuit when the relay winding ceases to be energized.

4. In a copying machine as defined in claim 3, the safety switch means comprising a normally closed switch connected in the self-holding circuit of the circuit-breaker means and means operative for opening the normally closed switch in automatic response to an attempt to gain access to the flash condensors.

5. In a copying machine as defined in claim 1, the copying machine including a pull-out unit, the battery of flash condensors being part of the pull-out unit, furthermore comprising a discharge circuit provided on the pull-out unit as a part thereof, the discharge circuit including at least one current-limiting resistor and normally open switch means, and furthermore including means for closing the normally open switch means and thereby causing the discharge circuit to quickly discharge the condensor battery in response to removal of the pull-out unit from the copying machine.

6. In a copying machine as defined in claim 1, the safety switch means comprising means for discharging the battery of flash condensors with a discharge time constant between 0.1 and 1.0 seconds.

7. In a copying machine as defined in claim 1, furthermore including discharge resistors non-disconnectably connected across the battery of flash condensors and operative for discharging the battery of flash condensors with a discharge time constant on the order of magnitude of a few minutes.

8. In an electrostatic copying machine, in combination, a flash discharge tube; means for causing the discharge tube to produce a flash, including a battery of flash condensors; and safety switch means operative, in response to an attempt to gain physical access to the flash condensors, for automatically effecting the quick discharging of the battery of flash condensors, furthermore including means operative when the copying machine is shut off at the end of a copying operation for automatically firing the flash discharge lamp.

9. In an electrostatic copying machine, in combination, a flash discharge tube; means for causing the discharge tube to produce a flash, including a battery of flash condensors; and safety switch means operative, in response to an attempt to gain physical access to the flash condensors, for automatically effecting the quick discharging of the battery of flash condensors, the copying machine including charging means for charging the battery of flash condensors, the battery of flash condensors being divided into at least two sections, furthermore including means operative for comparing the charging states of the sections of the condensor battery and in dependence upon detected discrepancies in the charging states slowing down or terminating the charging of the flash condensors.

10. In an electrostatic copying machine, in combination, a flash discharge tube; means for causing the discharge tube to produce a flash, including a battery of flash condensors; and safety switch means operative, in response to an attempt to gain physical access to the flash condensors, for automatically effecting the quick discharging of the battery of flash condensors, further comprising an adapter circuit connected across at least one of the flash condensors, the adapter circuit including at least one current-limiting resistor and a voltage-breakdown element and being provided with terminals across which a voltage-measuring unit can be connected.

11. In a copying machine as defined in claim 10, the voltage-breakdown element being a zener diode.

12. In a copying machine as defined in claim 10, the voltage-breakdown element being a glow discharge lamp.

13. In an electrostatic copying machine of the type comprising a toner-image-fixing station which includes a flash discharge lamp which emits radiation fixing the toner image, a battery of flash condensors connected across the flash discharge lamp for energizing the latter, guide means defining a transport path for a copying medium through the fixing station, and transport means for transporting a copying medium along the transport path through the fixing station, the improvement comprising the provision in the copying machine of a pull-out housing in which are mounted the flash discharge lamp, the battery of flash condensors, the guide means and the transport means, whereby the fixing station of the copying machine can be pulled out from the copying machine as a single unit, the pull-out housing including a condensor compartment in which the battery of flash condensors is mounted, the copying machine being provided with a cooling-air passage having an opening, the condensor compartment of the pull-out housing being provided with an opening, said openings being so located that when the pull-out housing is inserted into place in the copying machine communication is established between the cooling-air passage and the condensor compartment.

14. In a copying machine as defined in claim 13, the pull-out housing including a partition separating the condensor compartment from a lamp compartment containing the flash discharge lamp, the copying machine being provided with an additional cooling-air passage having an opening, the lamp compartment of the pull-out housing being provided with an opening, said openings of the pull-out housing and of the additional cooling-air passage being so located that when the pull-out housing is inserted into place in the copying machine communication is established between the additional cooling-air passage and the interior of the lamp compartment, the additional cooling-air passage terminating at its downstream end in a cooling-air discharge outlet, and further including in the additional cooling-air passage a carbon filter between the discharge outlet and the lamp compartment.

15. In an electrostatic copying machine of the type comprising a toner-image-fixing station which includes a flash discharge lamp which emits radiation fixing the toner image, a battery of flash condensors connected across the flash discharge lamp for energizing the latter, guide means defining a transport path for a copying medium through the fixing station, and transport means for transporting a copying medium along the transport path through the fixing station, the improvement comprising the provision in the copying machine of a pull-out housing in which are mounted the flash discharge lamp, the battery of flash condensors, the guide means and the transport means, whereby the fixing station of the copying machine can be pulled out from the copying machine as a single unit, the copying machine having a housing provided with a cover which when closed prevents pull-out of the fixing station from the copying machine, the cover being configured to include two downwardly curved guide portions which receive recording medium emerging from the fixing station and downwardly discharge the recording medium.

16. In a copying machine as defined in claim 15, the pull-out fixing station furthermore including means operative for effecting quick discharge of the flash condensors upon opening of the cover.

17. In an electrostatic copying machine of the type comprising a toner-image-fixing station which includes a flash discharge lamp which emits radiation fixing the toner image, a battery of flash condensors connected across the flash discharge lamp for energizing the latter, guide means defining a transport path for a copying medium through the fixing station, and transport means for transporting a copying medium along the transport path through the fixing station, the improvement comprising the provision in the copying machine of a pull-out housing in which are mounted the flash discharge lamp, the battery of flash condensors, the guide means and the transport means, whereby the fixing station of the copying machine can be pulled out from the copying machine as a single unit, the fixing station furthermore comprising control circuitry for charging the battery of flash condensors and for discharging the flash condensors through the flash discharge tube, the housing of the pull-out fixing station being provided with a mounting plate upon which the electrical components of the control circuitry are mounted, whereby to be removable from the copying machine with the remainder of the fixing station, the mounting plate being mounted for swinging movement to a position swung out from the pull-out housing, whereby to facilitate servicing and testing.

18. In an electrostatic copying machine of the type comprising a toner-image-fixing station which includes a flash discharge lamp which emits radiation fixing the toner image, a battery of flash condensors connected across the flash discharge lamp for energizing the latter, guide means defining a transport path for a copying medium through the fixing station, and transport means for transporting a copying medium along the transport path through the fixing station, the improvement comprising the provision in the copying machine of a pull-out housing in which are mounted the flash discharge lamp, the battery of flash condensors, the guide means and the transport means, whereby the fixing station of the copying machine can be pulled out from the copying machine as a single unit, the copying machine including control circuitry for controlling the operation of the copying machine including the charging of the flash condensors and discharging of the flash condensors through the flash discharge lamp, some of the circuit components of the control circuitry being provided on the housing of the pull-out fixing station and the remaining circuit components on the remainder of the copying machine, furthermore including electrical connectors connected to circuit components on the housing of the pullout fixing station and cooperating electrical connectors connected to circuit components on the remainder of the copying machine, the electrical connectors being so configured and located that when the pull-out fixing station is inserted into place in the copying machine electrical connections are established by the cooperating electrical connectors due to said configuration and locations.

19. In an electrostatic copying machine of the type comprising a toner-image-fixing staton which includes a flash discharge lamp which emits radiation fixing the toner image, a battery of flash condensors connected across the flash discharge lamp for energizing the latter, guide means defining a transport path for a copying medium through the fixing station, and transport means for transporting a copying medium along the transport path through the fixing station, the improvement comprising the provision in the copying machine of a pull-out housing in which are mounted the flash discharge lamp, the battery of flash condensors, the guide means and the transport means, whereby the fixing station of the copying machine can be pulled out from the copying machine as a single unit, the copying machine being provided with a cooling-air passage a part of which is constituted by the space within the pull-out fixing station containing the flash condensors, the flash condensors being elongate condensors mounted in the cooling-air passage parallel to one another and arranged one next to the other in the direction transverse to the air-flow direction of the cooling-air passage, the housing of the fixing station being provided with mounting brackets mounting the elongate condensors at the ends of the condensors.

20. In a copying machine as defined in claim 19, the flash condensors being electrolytic condensors each provided at a first end with an electrolyte relief valve, the first ends of the condensors being held in place by a common mounting bracket, the common mounting bracket being provided with a protective shield located to prevent electrolyte discharged from the relief valves from passing the protective shield.

21. In a copying machine as defined in claim 20, the condensors having terminals, and furthermore including conductors connecting these terminals to at least the flash discharge lamp, the conductors extending parallel to the common mounting bracket within the latter behind the protective shield.

22. In a copying machine as defined in claim 19, the condensors being generally cylindrical condensors having a length at least three times their diameter.

* * * * *